428-908.8
C5192 XR 4,348,241 SR /8

United [redacted] [11] 4,348,241
Kunioka et [redacted] [45] Sep. 7, 1982

[54] HEAT-TREATMENT OF SEMIFINISHED PRODUCT-SLIDING SURFACE OF SHAPING MEMBERS IN PLASTIC METAL-WORKING APPARATUS

[75] Inventors: Saburo Kunioka, Kawagoe; Hatsuo Kawaguchi, Ogawa; Minoru Ōno, Hidaka, all of Japan

[73] Assignee: Shinhokoku Steel Corporation, Kawagoe, Japan

[21] Appl. No.: 233,859

[22] Filed: Feb. 12, 1981

[51] Int. Cl.[3] ..... C23F 7/04
[52] U.S. Cl. ..... 148/6.35; 148/31.5
[58] Field of Search ..... 148/6.35, 31.5

[56] References Cited

U.S. PATENT DOCUMENTS 2,073,501 3/1937 Stargardter ..... 148/6.35
2,269,943 1/1942 Kiser ..... 148/6.35
2,543,710 2/1951 Schmidt et al. ..... 148/6.35
3,526,550 9/1970 Larson et al. ..... 148/6.35
4,035,200 7/1977 Valentijn ..... 148/6.35

*Primary Examiner*—Ralph S. Kendall
*Attorney, Agent, or Firm*—Frishauf, Holtz, Goodman & Woodward

[57] ABSTRACT

A shaping ferrous metal member used in a metal-working apparatus is heat-treated at about 1,000° C. for several hours in an incompletely burning fuel gas, to provide a burned gas atmosphere composed of 0.5 to 5.0% of CO, 8 to 12% of $CO_2$, 0 to 0.5% of $O_2$. A tough iron oxide layer of high quality is tightly deposited with a uniform thickness by said heat-treatment on the surface of shaping metal member which is abrasively contacted by a sliding semifinished metal product. The advantageous effect of this method is that a consumable shaping metal member has a life 2 to 4 times longer than that of a metal member which is conventionally heat-treated in a completely-burning fuel gas.

12 Claims, 10 Drawing Figures

HEAT-TREATMENT OF SEMIFINISHED PRODUCT-SLIDING SURFACE OF SHAPING MEMBERS IN PLASTIC METAL-WORKING APPARATUS

BACKGROUND OF THE INVENTION

This invention relates to heat-treatment of shaping metal member used in an apparatus for plastic metal-working such as rolling, drawing, extrusion, seamless tubing, contour forging and die casting, and more particularly to a process of oxidative heat-treating the rubbing surface of the shaping metal member which is abrasively contacted with a semifinished metal product which slides over said surface with high pressure. By this oxidative heat-treatment, a heat-resistant metal oxide layer is deposited on the surface of shaping metal member, reducing the depletion thereof caused by the sliding of the semifinished metal product.

Brief description is now given of one form of the above-mentioned working of plastic metal with regard to seamless tubing for example.

The process for making seamless tube comprises heating a raw rod steel material to a temperature of about 1,200° C. for softening; boring the softened steel rod with a piercing plug; broadening the inner diameter of the bore with an elongating plug; causing the workpiece to have an inner diameter and thickness approximately those realized in a final size by applying a rolling plug; and finishing at last a seamless tube with a reeler plug.

Seamless tubing mill's tools such as the above-mentioned various plugs are subjected to high pressure and temperature in practical operation. Therefore, abrasion, melting loss and seizing take place on the semiwork sliding surface, resulting in deformation or damage which occurs quickly in the tubing mill tools. Since such a deformed or damaged tubing mill tool is no longer useful for practical purpose, the tubing mill tube is a highly consumable article which has to be replaced often by a new one.

The seamless tubing mill tools are generally made of wear resistant low alloyed cast steel or highly heat resistant high carbon stainless cast steel. Yet, the tubing mill tools formed from the low alloyed steels are capable of being applied only a few times. Though applicable more often than such mill tools, the mill tools formed from the stainless cast steel are too expensive for practical application.

A known process (Japanese patent application publication No. 3884/1975) for extending the effective life of a piercing plug made of alloyed cast steel comprises heat-treating a piercing plug in an atmosphere of an ordinary fuel burning gas at a temperature of about 1,000° C. for several hours to deposit a thin metal oxide layer on the surface of the piercing plug, and fixing the thin layer to the surface by slowly cooling the piercing plug, thereby improving the heat and wear resistances of the piercing plug for the extension of its life.

However, the thin metal oxide layer thus obtained is ready to fall off the surface of a metal substrate or fails to be deposited on said surface in a thin layer of uniform quality. Therefore, the above-mentioned process can not be regarded as capable of prominently extending the life of a piercing plug.

FIG. 1 is an 80-times magnified microscopic photograph of a longitudinal section of a piercing plug made of low alloyed cast steel containing 0.3% C, 3% Cr and 1% Ni, heat-treated for 3 hours in an atmosphere of ordinary CO-free completely burned gas at a temperature of 950° C., cooled to 500° C. in the furnace used, and quenched by air cooling. FIG. 1 shows that the above-mentioned heat-treatment gave rise to the formation of double layers consisting of an inner metal oxide layer 11 and outer metal oxide layer 12 on the surface of a metal substrate, over which a semifinished product is expected to slide abrasively. The outer metal oxide layer 12 mainly consisting of $Fe_3O_4$ and containing a small amount of $Fe_2O_3$ is brittle and readily damaged by abrasion, and has a greater thickness than the inner metal oxide layer 11.

The inner metal oxide layer 11, mainly consisting of $FeO.Cr_2O_3$ and containing a small amount of FeO, is tougher than the outer layer 12, but is ready to be damaged by abrasion due to its small thickness. If it is tried to increase the thickness of the inner layer 11 by adjusting the conditions of heat-treatment, then the outer layer 12 increases in thickness to a corresponding extent, presenting difficulties in ensuring the dimensional precision of the piercing plug.

FIG. 2 is an 80-times magnified microscopic photograph of a longitudinal section of a rolling plug which was made of high carbon cast stainless steel containing 1.2% C, 17% Cr and 2% of Mo and W together, heat-treated in an ordinary CO-free completely burned gas at a temperature of 1,070° C. for 4 hours, cooled in the furnace used to 880° C., kept at this temperature for 1 hour, and quenched by air cooling.

FIG. 2 shows that the above-mentioned heat-treatment produces a single layer 21 of metal oxide on a metal substrate 20. In the case of high carbon cast stainless steel, the double layers of metal oxide which is shown in FIG. 1 are not produced on the surface of heat-treated plug. The metal oxide layer 21 of FIG. 2 has the same composition as the inner metal oxide layer 11 of FIG. 1 which is heat-insulating and wear resistant. The metal oxide layer 21 has an appreciably great thickness on the average, but is regrettably of non-uniform quality, and is sparsely deposited on the metal substrate 20. Therefore, the metal oxide layer 21 also fails to sustain a long period of resistance to abrasion.

For reference, the upper dark portion 13 of FIGS. 1 to 8 denotes a resin used to fix a sample in place to obtain a cut plane surface of the sample. The black portion 22 of FIGS. 2 to 8 which appears below the dark portion 13 or in the intermediate part thereof represents a gap produced in the resin when it shrinks due to hardening.

SUMMARY OF THE INVENTION

It is accordingly the object of this invention to provide a method of heat-treating the surface of a shaping metal member such as a seamless tubing mill tool used in a plastic metal-working apparatus which is abrasively contacted by a semifinished metal product, and forming a metal oxide layer on said surface with a uniform thickness and greater adhesion than has been possible in the past, thereby effectively protecting the mill tubing tool as a whole from damage.

The above-mentioned object is attained by heat-treating a shaping metal member not in an atmosphere of completely fuel-burning gas as applied hitherto, but in an atmosphere of incompletely fuel-burning gas, whose burning is so controlled as to cause the composition of said burned gas to be formed of 0.5 to 5.0% of CO, 8 to 12% of $CO_2$, 0 to 0.5% of $O_2$, 16 to 18% of $H_2O$, and $N_2$ and other inert gases collectively constituting the remainder at a temperature of 900° to 1,200° C. for a prescribed length of time, for example 3 to 5 hours, and later carrying out cooling in the same manner as in the prior art.

BRIEF DESCRIPTION OF THE DRAWINGS

The method of this invention will be better understood with reference to the accompanying drawings, in which.

DETAILED DESCRIPTION OF THE PREFERRED EMBODIMENT

Figure 1:
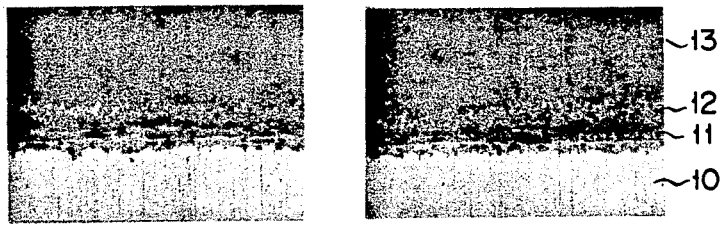
FIG. 1 (PRIOR ART)
FIG. 1 is an 80-times magnified microscopic photograph of a longitudinal partial section of a piercing plug of low alloyed cast steel which is heat-treated in an atmosphere of a completely fuel-burned gas in accordance with the prior art method.

The description is now given of the formation of a seamless tube as an example of the working of a plastic iron material.

Piercing plugs of low alloyed cast steel such as plugs used in a piercing or elongating machine for the manufacture of seamless steel tube were heat-treated at 950° C. for 3 to 15 hours in a heating furnace using an ordinary complete combustion of propane or butane gas. By this ordinary heat-treatment, double layers of metal oxide were deposited on the surface of the substrate metal 10 as previously described with reference to FIG. 1. The double layers consist of an outer brittle metal oxide layer 12 which mainly consists of $Fe_3O_4$, having a thickness of, for example, about 150 microns, and is superposed on a thin inner dense metal oxide layer 11 which mainly consists of FeO, having a thickness of, for example, about 35 microns and being attached tightly to the metal substrate 10.

On the other hand, a rolling plug of high carbon cast stainless steel was heat-treated for 4 hours at a temperature of 1,070° C. in an atmosphere obtained in the same manner as in the preceding case. By this ordinary heat-treatment, a single layer 21 of metal oxide was deposited on the surface of metal substrate 20 as previously described with reference to FIG. 2. The single layer 21 mainly consists of $FeO.Cr_2O_3$, having a thickness of about 80 microns and being attached sparsely to the metal substrate 20.

The above-mentioned two kinds of heat-treated tubing mill tools have a higher wear resistance than when not heat-treated. Namely, the heat-treated mill tools are generally reused 10 to 20 times, whereas the mill tool which is not heat-treated is reused only 2 to 4 times.

As mentioned above, the prior art process of heat-treating a mill tool comprises completely burning a gaseous fuel in a furnace using an excess amount of secondary air. In contrast, the method of this invention comprises insufficiently burning the fuel by controlling the amount of secondary air in order to obtain burned gas composed of 0.5 to 5.0% of CO, 8 to 12% of $CO_2$, 0 to 0.5% of $O_2$, 16 to 18% of $H_2O$ and the remainder of inert gases. When double layers of metal oxide are produced by the method of this invention, the outer brittle layer has a smaller thickness and the inner dense layer has a greater thickness. When a single dense layer is produced by the method of this invention, it has a greater thickness than said inner layer, and is uniformly adhered to the metal substrate without breaks. It has been discovered that, in the both cases of single and double metal oxide layers, a mill tool heat-treated according to the method of this invention is reuseable in a frequency 2 to 4 times higher than in the prior art heat-treating process.

The reason why the atmosphere of insufficiently burned gas containing a prominent amount of CO gas gives an advantageous effect as mentioned above is not yet clearly defined. However, we assume that, the insufficiently burned gas also contains $CO_2$ having an oxidizing power together with CO having a reducing power, and the following two chemical equilibrium would take place on the surface of mill tools.

$$Fe + CO_2 \rightleftharpoons FeO + CO$$

$$3FeO + CO_2 \rightleftharpoons Fe_3O_4 + CO$$

According to these chemical equilibrium, the oxidizing reaction is restricted by the presence of CO, preventing the oxidation of Fe from proceeding to $Fe_2O_3$. Further, the layer of $Fe_3O_4$ is reduced in thickness, and a layer of FeO representing the lowest degree of oxidation is prominently grown. In the case of high carbon stainless cast steel, $FeO.Cr_2O_3$ is easily produced in the rolling plug because of rich Cr content, which restricts the diffusion of Fe in the layer, suppressing the growth of $Fe_3O_4$.

When the concentration of CO in the incompletely burning gas exceeds 5%, dirty soot noticeably appears in the furnace. When the insufficiently burning gas contains too little CO, any noticeably favorable effect is not realized. As far as the practical application of the method of this invention permits, the content of CO in the insufficiently burning gas is chosen to range between 0.5 and 5.0% or preferably between 1 and 4%.

EXAMPLES

Example 1

Figure 3:
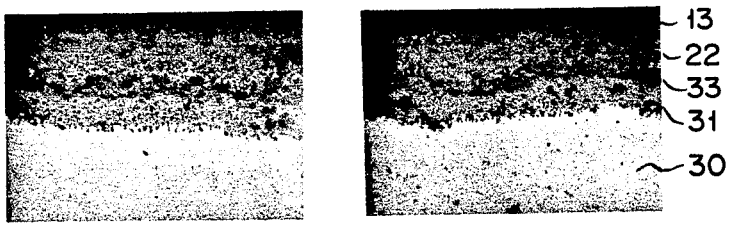
FIGS. 3, 5 and 7 are similar 80-times magnified microscopic photographs of longitudinal partial sections of piercing plug of low alloyed cast steel which are heat-treated in accordance with the method of this invention, respectively.

A piercing plug of low carbon nickel-chromium cast steel containing approximately 0.3% of C, 3% of Cr and 1% of Ni was heat-treated for 3 hours at 950° C. in a furnace atmosphere of incompletely burning propane gas to provide a gas composed of 0.8 to 1.2% of CO, 10 to 12% of $CO_2$, 0 to 0.5% of $O_2$, 16 to 18% of $H_2O$ and $N_2$ jointly constituting the remainder. The thus heat-treated piercing plug was cooled to about 500° C. in the furnace and finally annealed. FIG. 3 is an 80-times magnified photograph of a longitudinal partial section of the heat-treated piercing plug including the surface portion thereof which is to be abrasively contacted by a sliding semifinished metal product.

FIG. 3 shows double metal oxide layers. One of these oxide layers is an inner metal oxide layer 31 formed tightly on a metal substrate 30. This oxide layer 31 mainly consists of FeO, contained some $FeO.Cr_2O_3$, and having a thickness of about 110 microns. The other of the double metal oxide layers is an outer layer 22 which is superposed on said inner layer 31, mainly consisting of $Fe_3O_4$ containing some amount of $Fe_2O_3$, and having a thickness of about 110 microns.

A prior art piercing plug having a surface structure shown in FIG. 1 had an effective life to produce about 80 intermediate tube products. In contrast, a piercing plug embodying this invention which has a surface structure shown in FIG. 3 has an effective life to produce about 230 intermediate tube products under the same conditions as in the prior art process. Namely, the piercing plug made by the present invention has a life about 3 times longer than the conventional type.

The black portion 33 of FIG. 3 denotes a gap produced when the outer layer 22 peeled from the inner layer 31.

Example 2

Figure 4:
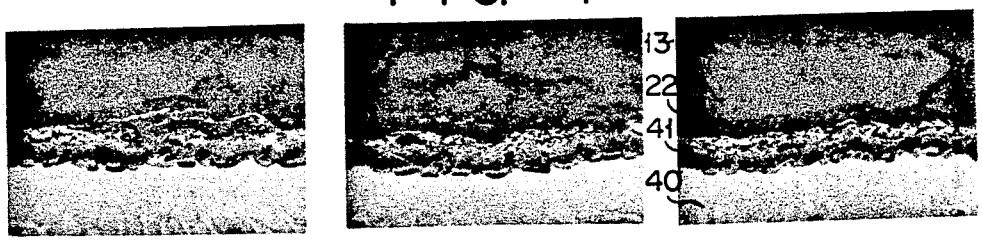
FIGS. 4, 6 and 8 are similar 80-times magnified microscopic photographs of longitudinal partial sections of rolling plugs of high carbon cast stainless steel which are heat-treated in accordance with the method of this invention, respectively.

A rolling plug of high carbon chromium-molybdenum-tungsten cast steel containing 1.2% of C, 17% of Cr and 2% of Mo and W together was heat-treated for 4 hours at 1,070° C. in a furnace atmosphere of incompletely burning propane gas to provide a gas having the same composition as in Example 1. The thus heat-treated rolling plug was cooled to 880° C. in the furnace, kept at this temperature for one hour, and quenched by air cooling. FIG. 4 is an 80-times magnified photograph of the longitudinal partial section of the heat-treated rolling plug including that surface portion thereof which is to be adhesively contacted by a sliding semifinished metal product.

FIG. 4 shows a metal oxide layer 41 (corresponding to the inner metal oxide layer 31 of FIG. 3) which mainly consists of $FeO.Cr_2O_3$ and is formed on a metal substrate 40 with a thickness of about 110 microns. As seen from FIG. 4, this layer 41 is so tightly attached to the metal substrate 40 as to appear to be embedded therein. An outer metal oxide layer 22 as indicated in FIG. 3 is not formed on the surface of the metal oxide layer 41 of FIG. 4.

Figure 2:
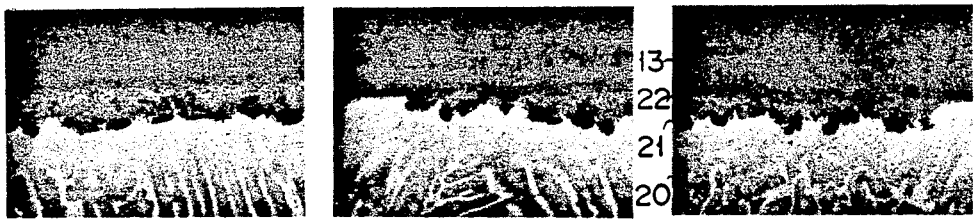
FIG. 2 (PRIOR ART)
FIG. 2 is a similar 80-times magnified microscopic photograph of a longitudinal partial section of a rolling plug of high carbon cast stainless steel which is heat-treated in accordance with the conventional method as in the case of FIG. 1.

A prior art rolling plug, whose surface has the structure shown in FIG. 2, can produce about 30 to 60 intermediate tube products. In contrast, a rolling plug embodying this invention, whose surface has the structure shown in FIG. 4 can produce 80 to 100 intermediate tube products. Therefore, the rolling plug heat-treated by the method of this invention has an effective life about twice longer than that of the conventional type.

The black portion 22 of FIG. 4 denotes a gap occurring when the hardened resin layer 13 peels from the metal oxide layer 41.

Example 3

Figure 5:
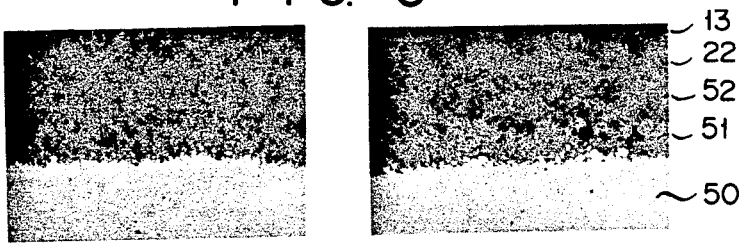

FIG. 5 is a similar microscopic photograph as that of FIG. 3. The plug, the heat-treatment and the annealing condition are the same as in Example 1. However, the composition of the incompletely burned gas was changed to 2.8 to 3.2% of CO, 9 to 11% of $CO_2$ and 0 to 0.5% of $O_2$. In this case, double metal oxide layers were inevitably produced. The inner layer had a thickness of about 115 microns, and the outer layer had a thickness of about 225 microns.

Reference numeral 50 denotes a metal substrate; 51 shows the inner metal oxide layer; 52 indicates the outer metal oxide layer; and 22 represents a gap produced when the resin layer 13 contracted due to hardening.

Example 4

Figure 6:
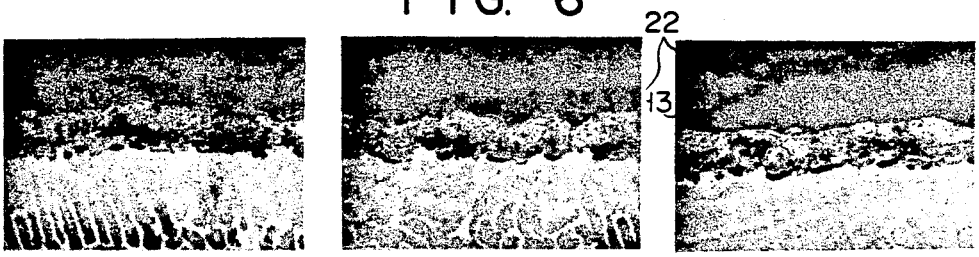

FIG. 6 is a similar microscopic photograph as that of FIG. 4. The plug, the heat-treatment and the quenching conditions were the same as in Example 2, and the main components of the incompletely burned gas was chosen to be the same as those of Example 3. The heat-treated surface of the plug of FIG. 6 has a structure little different from that of FIG. 4 (Example 2), having a single metal oxide layer of thickness of about 125 microns. In the case of FIG. 6, however, the single metal oxide layer had a greater thickness than that of Example 2. Consequently, the plug proved to have an effective life about 10% increased over that of Example 2.

Examples 5 and 6

Figure 7:
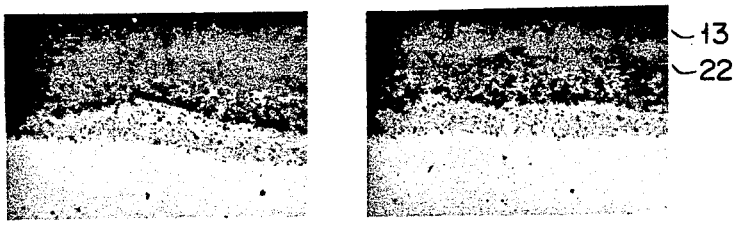
Figure 8:
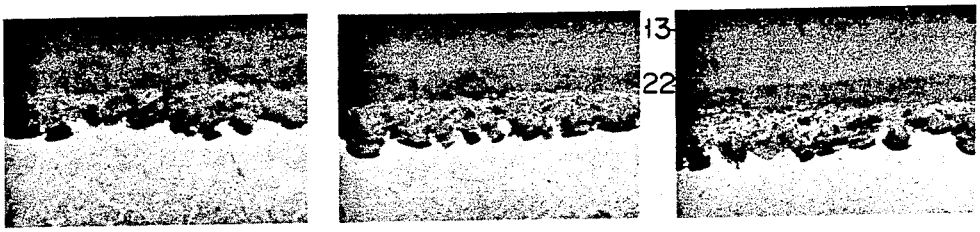

FIGS. 7 and 8 are microscopic photographs of the surface structure of a piercing plug and a rolling plug, respectively, which were both heat-treated with an incompletely burned gas atmosphere in a furnace, composed of 3.7 to 4.1% of CO, 8.5 to 11% of $CO_2$, 0 to 0.5% of $O_2$. In the case of FIG. 7, the heat-treated piercing plug was annealed under the same manner as in the preceding embodiment. In the case of FIG. 8, the rolling plug was quenched under the same conditions as in the preceding Example.

In Example 5, both outer and inner metal oxide layers had a slightly smaller thickness than in Example 3. In Example 6, the single metal oxide layer had a slightly greater thickness than in Example 4. At any rate, Examples 5 and 6 displayed almost the same effect as in the preceding Examples.

Figure 9:
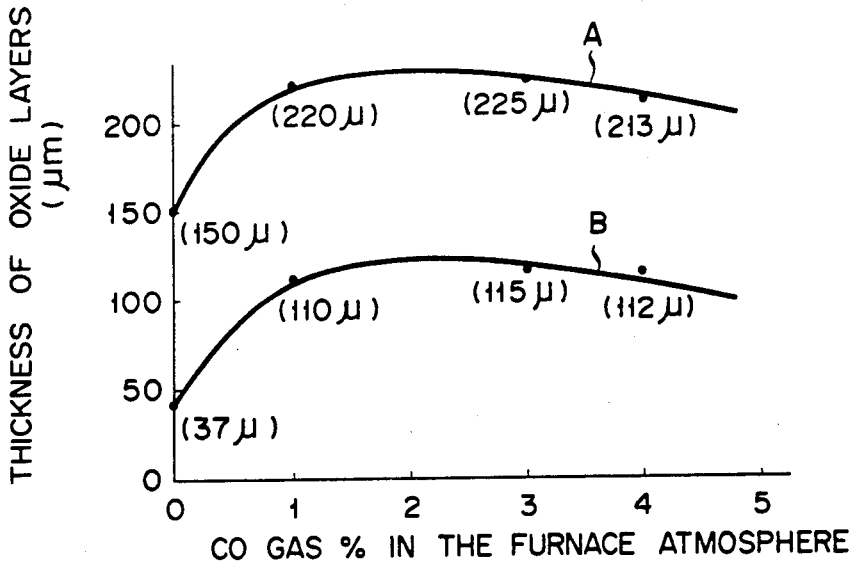
FIG. 9 is a curve diagram showing the average thickness of double metal oxide layers corresponding to the CO content of the heat-treating atmosphere, where a piercing plug of low alloyed cast steel is heat-treated in accordance with the method of this invention.

FIG. 9 is a curve diagram showing relationships between the thicknesses of metal oxide layers deposited on a piercing plug heat-treated in Examples 1, 3 and 5 and the concentrations of CO contained in the furnace atmosphere of incompletely burned gas. Curve A shows the total thickness of double layers of metal oxide. Curve B denotes the thickness of inner metal oxide layer. Therefore, the difference between the value of curve A and of curve B at a given point of CO concentration represents the thickness of outer metal oxide layer. Numerals in parenthesis represent the actually measured values of the thickness.

Figure 10:
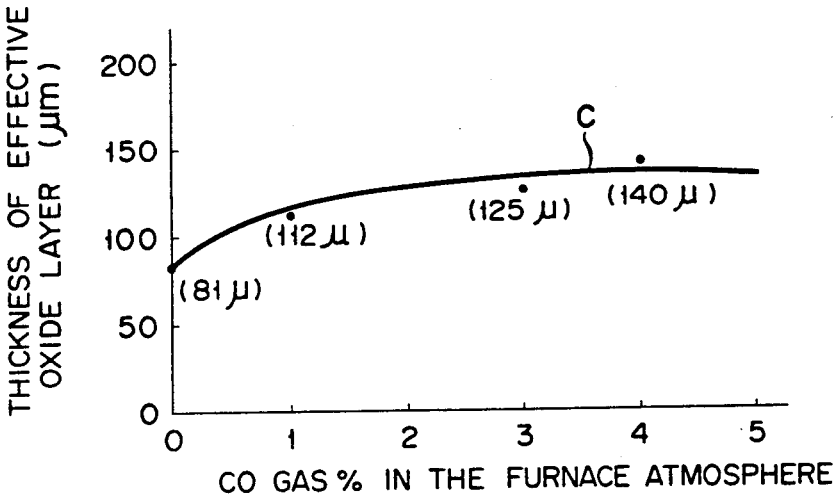
FIG. 10 is a curve diagram showing the average thickness of a single metal oxide layer corresponding to the CO content of the heat-treating atmosphere, where a rolling plug of high carbon cast stainless steel is heat-treated in accordance with the method of this invention.

FIG. 10 is a curve diagram indicating relationships between the thicknesses of single metal oxide layers deposited on the surface of a rolling plug as a result of heat-treatment carried out in the Examples 2, 4 and 6 and the concentration of CO. Curve C shows the thickness of single metal oxide layer. Numerals in parenthesis are also the actually measured values of the thicknesses of single metal oxide layer at points corresponding to the CO concentrations.

The foregoing description refers to the heat-treatment of a seamless tubing mill tool used in the manufacture of steel tubes. However, the method of this invention is not limited to said heat-treatment, but is applicable to the heat-treatment of a frictional metal member, used in a plastic metal-working apparatus, such as a metal mold for die forging; a guide shoe of high carbon chromium cast steel used in the manufacture of seamless tubes; an entry guide applied in rolling work; a pusher head used in die casting; and an extrusion die.

What we claim is:

1. A method of heat-treating the sliding surface of a shaping ferrous metal member used in a metal-working apparatus which in service is abrasively contacted with a sliding semifinished ferrous metal product to provide a coated sliding surface which has superior abrasion resistance, said method comprising the steps of:

placing the shaping metal member in a furnace using a gaseous fuel;

incompletely burning the fuel to provide an atmosphere composed of 1 to 4% of CO, 8 to 12% of $CO_2$, 0 to 0.5% of $O_2$, 16 to 18% of $H_2O$, and $N_2$ and other inert gases jointly constituting the remainder by means of controlling the amount of secondary air introduced into the furnace;

heating the shaping metal member in said atmosphere at a temperature of from 900° to 1,200° C. for 3 to 5 hours; and annealing or quenching the heat-treated metal member.

2. The method of claim 1, wherein the metal-working apparatus is used in rolling, drawing, extrusion, formation of seamless tubes, die forging or die casting.

3. The method of claim 1, wherein the shaping metal member is a piercing plug, a rolling plug, an elongated plug or a guide shoe used in forming seamless tubes.

4. The method of claim 1, wherein the gaseous fuel is selected from the group consisting of propane and butane.

5. The method of claim 1, wherein the shaping metal member is a piercing plug composed of low carbon alloyed steel or rolling plug composed of a high carbon cast stainless steel.

6. The method of claim 1, wherein the heat-treated shaping metal member is composed of low carbon alloyed steel and is annealed.

7. The method of claim 1, wherein the heat-treated shaping metal member is composed of high carbon cast stainless steel and is quenched by air cooling.

8. The method of claim 1, wherein the shaping metal member is an entry guide used in rolling.

9. The method of claim 1, wherein the shaping metal member is an extruding die.

10. The method of claim 1, wherein the shaping metal member is a metal mold used in die forging.

11. The method of claim 1, wherein the shaping metal member is a pusher head in die casting.

12. A shaping ferrous metal member having an abrasion-resistant sliding surface, said abrasion-resistant surface having a surface oxide layer produced by the process of claim 1.

* * * * *